United States Patent [19]

Allen

[11] 4,434,849

[45] Mar. 6, 1984

[54] METHOD AND APPARATUS FOR RECOVERING HIGH VISCOSITY OILS

[75] Inventor: Joseph C. Allen, Bellaire, Tex.

[73] Assignee: Heavy Oil Process, Inc., Dallas, Tex.

[21] Appl. No.: 232,987

[22] Filed: Feb. 9, 1981

Related U.S. Application Data

[63] Continuation-in-part of Ser. No. 108,815, Dec. 31, 1979, abandoned, which is a continuation-in-part of Ser. No. 940,390, Sep., 1978, Pat. No. 4,257,650.

[51] Int. Cl.[3] ..... E21B 43/24; E21B 47/00

[52] U.S. Cl. ..... 166/252; 166/50; 166/272

[58] Field of Search ..... 166/250, 252, 263, 272, 166/268, 269, 303, 50; 299/2

[56] References Cited

U.S. PATENT DOCUMENTS

| | | | |
|---|---|---|---|
| 3,118,499 | 1/1964 | Johnson et al. | 166/269 X |
| 3,371,711 | 3/1968 | Odeh et al. | 166/268 |
| 3,385,360 | 5/1968 | Smith | 166/272 |
| 3,467,191 | 9/1969 | Van Daalen et al. | 166/269 |
| 3,682,244 | 8/1972 | Bowman et al. | 166/272 |
| 3,948,323 | 4/1976 | Sperry et al. | 166/303 |
| 4,022,279 | 5/1977 | Driver | 166/50 X |
| 4,099,783 | 7/1978 | Verty et al. | 166/50 X |
| 4,121,661 | 10/1978 | Redford | 166/272 X |
| 4,160,481 | 7/1979 | Turk et al. | 166/50 X |
| 4,227,743 | 10/1980 | Ruzin et al. | 166/272 X |

OTHER PUBLICATIONS

Ranney, "The First Horizontal Oil Well", *The Petroleum Engineer*, Jun. 1939, pp. 25–30.

*Primary Examiner*—Stephen J. Novosad
*Assistant Examiner*—George A. Suchfield
*Attorney, Agent, or Firm*—Bard, Groves, Sroufe, Bishop & Berger

[57] ABSTRACT

Improved methods and apparatus are provided for recovering high viscosity oils from a sub-surface earth formation utilizing horizontal well apparatus. A plurality of horizontal drill holes extend from a large diameter vertical shaft hole into the formation of interest. Steam may be injected into the formation through selectively placed conventional vertical wells terminating within the oil-bearing formation, while oil is recovered from the lateral drill holes. A noncondensible gas or cold water may be injected into the formation subsequent to steam injection to enhance the overall recovery of oil.

15 Claims, 4 Drawing Figures

METHOD AND APPARATUS FOR RECOVERING HIGH VISCOSITY OILS

RELATED PATENT APPLICATIONS

This is a continuation-in-part of co-pending U.S. patent application Ser. No. 108,815, filed Dec. 31, 1979, now abandoned, which is a continuation-in-part of U.S. patent application Ser. No. 940,390, filed Sept. 7, 1978, now U.S. Pat. No. 4,257,650.

BACKGROUND OF THE INVENTION

This invention relates to methods and apparatus for recovering high viscosity oils from subsurface earth formations, and more particularly relates to improved methods for recovering such oils by employing a large diameter shaft hole and a plurality of horizontal drill holes extending radially from the shaft hole.

Early disclosures relating to the recovery of petroleum substances by utilizing a large diameter shaft hole and a plurality of substantially horizontal drill holes are provided in U.S. Pat. Nos. 1,520,737 and 1,634,235, and a paper published by Ranney in the *Petroleum Engineer* in 1939 entitled "The World's First Horizontal Well". These publications propose the drilling of a large diameter shaft into an oil-bearing formation and then drilling radial drill holes into the formation. More recently, U.S. Pat. Nos. 4,020,901; 4,099,570; 4,099,783; 4,116,275; 4,160,481; and 4,201,420 provide improved systems for recovering petroleum substances employing large diameter shaft holes and radial drill holes.

Some of the above processes, however, suffer limitations relating to restrictions on the rate of introducing the injected fluid into the formation, which reduces the oil recovery rate. The techniques described in the above-cited patents may be suitable for recovering oil in some formations, but are not believed to be economically feasible for recovering oil from many formations. More particularly, such techniques are believed to recover a relatively low percentage of the oil in the formation, and many of these techniques demand high fuel requirements which further reduce the net oil recovery rate.

Oil recovery techniques utilizing conventional vertical wells can be generally classified as "drive" operations or "soak" operations. In a "drive" operation, a fluid is generally injected into the formation at a first location to form a wall for driving the oil in the formation toward recovery at a second location. The objective of a drive operation is to form a displacing fluid boundary and then drive the boundary through the formation utilizing the pressure of the injected fluid. Thus, in a dynamic drive operation, fluid is injected at a first point while oil is being recovered from a second point.

A major problem with most dynamic drive operations is that care must be taken to keep the injected fluid front in a wall configuration during the driving process. In operation, several factors naturally contradict the ideological driving wall of the dynamic drive operation, including variance in formation matrix, density and viscosity variations between the injected fluid and the oil in the formation, pressure and temperature changes about the formation, and gravitational forces.

When the driving wall breaks down, the phenomenon is typically referred to as either "fingering" or "gravity override", which are discussed in detail in the co-pending patent applications. A breakdown of the dynamic driving wall causes a significant reduction in the oil recovery efficiency of the dynamic driving process, and is a principal reason for its limited applicability.

In conventional vertical well "soak" operations, a solvent or steam may be injected into the formation for the purpose of reducing the viscosity of the oil, thereby allowing the oil to flow by gravity to recovery lines. "Soak" operations are generally not concerned with generating a wall of injected fluid, but are principally concerned with filling the formation with the soaking fluid to reduce the viscosity of the oil throughout the formation. In soak operations, the reduced viscosity oil generally flows by gravitational forces to recovery wells, and may be recovered at the same locations fluid is injected. Since a dynamic drive is not desired for a soaking process, a soaking fluid is generally not injected during the time interval in which oil is being recovered.

Soak operations are generally burdened, however, with relatively poor oil recovery efficiencies. Thus, it is not uncommon to soak a formation several times over a period of years. The cost of the fuel to generate steam is a major deterrent to the economic feasibility of soak operations. In addition, the slow rate of recovery common to soak operations substantially increases the cost of recovering oil, since expensive steam generating and water treatment equipment must be available during the life of the soak operation.

Conventional vertical well soak and drive techniques, when applied to horizontal well technology, are subjected to additional and/or different problems. One of the major problems with soak technology in conventional vertical wells is that the steam must invade or sweep through all the formation, and does not inadvertently rise over a portion of the formation because of the low density of steam. In horizontal wells, on the other hand, steam may be injected into the bottom of the wells along the length of the laterals, and thus the formation is more effectively saturated with steam since the steam rises naturally through the formation. Thus, horizontal well operations are not typically concerned with problems associated with soaking the entire formation, as in the case of conventional vertical well soak operations. Also, horizontal well soak operations are generally thought to be much more efficient than vertical well soak operations, since oil may be recovered over the long length of the laterals at the bottom of the formation, as compared to the points of recovery provided at the bottom of a formation by conventional vertical wells. Nevertheless, many horizontal well soak operations suffer from slow recovery rates and poor overall recovery efficiency.

Drive technology also becomes substantially altered when adapted to horizontal well configurations. Driving horizontally between horizontal wells commencing from a large diameter vertical well may not be practical because of difficulty in maintaining an effective wall of driving fluid. Also, since the spacing between adjacent laterals will vary with the distance from a common large diameter vertical well, the conventional univelocity wall driving techniques may not be applicable. Further, the close proximity of the laterals near a common diameter vertical well may result in steam fingering horizontally and short-circuiting between adjacent laterals.

The distinction between drive and soak operations is not always as simplistic as described above, although fundamental differences exist between these two techniques. Also, as previously described, a substantial variance exists between drive and soak operations adapted for horizontal well technology and drive and soak operations adapted for vertical well technology. Although horizontal wells generally offer the advantage of increased efficiency of oil recovery as compared with vertical wells, the costs associated with mining and operating a horizontal well are often heretofore prohibitive. Also, although horizontal steam soak operations are generally more efficient than vertical well steam soak operations, the efficiency of prior art horizontal well soak operations, when combined with the increased economic investment for horizontal wells, is such that oil recovery may not be practical.

The problems and disadvantages of the prior art are overcome with the present invention. Novel methods are herein provided for recovering high viscosity oils from a subsurface earth formation, wherein a greater percentage of the oil can be recovered from the formation, and can be recovered in a shorter time period.

SUMMARY OF THE INVENTION

In an ideal embodiment of the present invention, a vertical mine shaft or the like is bored or dug from the surface to the formation of interest, whereby personnel and equipment can reach the base of the formation. More particularly, the portion of the borehole across the formation is preferably enlarged laterally so as to provide a work chamber of a shape and size sufficient to permit operations to be conducted at the base of the formation in an appropriate manner, subject to whatever shoring may be required under particular conditions. Thereafter, drill holes are bored into the face of the formation and radially about the chamber in the lower portion of the formation. The plurality of substantially horizontal drill holes serve as recovery lines enabling the oil in the formation to efficiently flow to the large diameter bore hole, so that the oil may subsequently be pumped to the surface by conventional means. The invention is particularly suitable for recovering high viscosity oils, which are generally inclusive of both medium gravity oils having an API range of 20° to 25°, and heavy crude oils having an API range of 20° or less.

The particular spacing and arrangement of the drill holes will, of course, depend on the size and lithology of the formation of interest, but it is a feature of the invention to provide approximately eight different radially extending drill holes from each shaft hole, and to further extend such drill holes to a location adjacent the ends of similar radials extending from an adjacent vertical shaft hole. As will hereinafter be described in detail, each group of radial drill holes will then define a rectangular pattern within the field, and thus the field may be effectively "covered" with a blanket of such rectangular patterns. The radials themselves will usually extend in a generally horizontal direction, although it may be preferable to extend the radials parallel with the lower plane of a tilted formation, e.g., two feet above the bottom surface of the tilted formation. Alternatively, the radials may be positioned at a slight upward angle relative to their respective shaft hole in order to accommodate gravity flow of the oil from the formation.

According to one embodiment of this invention, steam is injected into the formation from a plurality of vertical wells terminating within the oil bearing formation. Eight drill holes extend horizontally into the lower portion of the formation from a large diameter shaft hole, and serve as recovery laterals. The vertical wells terminate at an elevation slightly higher than the horizontal laterals, and are horizontally spaced between respective recovery laterals. The steam may be injected simultaneously into the formation from that portion of each of the vertical wells within the oilbearing formation. The injected steam rises vertically within the formation due to gravitational forces, and also permeates the formation horizontally as steam is continually injected. Steam is injected into the formation from the vertical wells while oil is recovered from the horizontal laterals, and the oil is thereby recovered utilizing a dynamic driving process.

This embodiment of the invention is of significant advantage over horizontal driving techniques, since the process does not principally rely on driving the oil horizontally within the formation. The process described herein is thus not burdened by the detrimental effects of fingering and gravity override common in horizontal drive techniques. Also, the vertical wells enable the oil in the formation to be effectively heated to decrease the viscosity of the oil in the formation and thus reduce the force necessary to drive the oil to the recovery laterals. The oil is thereby driven both vertically and horizontally toward the recovery laterals, to enhance the overall recovery efficiency.

A principal benefit to the above technique is that energy is not wasted moving oil about in the formation. Thus more oil may be recovered with less steam and therefore less fuel costs. Recovery of oil according to the techniques herein described requires a large initial investment of time and monies, and also a substantial continued investment of time and machinery as long as recovery process is active. Thus, the present invention has the advantage of substantially increasing the production rate which improves the rate of return on the investment and thereby enhances the economics of the recovery process. The net result is that less economic investment in equipment and fuel is used to recover a higher percentage of oil from the formation.

A particular feature of this invention is to provide methods and apparatus that allow for increased production rates of recovering high viscosity oil from subsurface earth formations. Higher rates of recovery for oil often yield an increased overall efficiency of the recovery process, as long as gravity override and viscous fingering can be avoided.

It is another feature of this invention to provide a plurality of laterals extending radially into a portion of an oil bearing formation from a large diameter shaft hole, wherein the laterals serve as recovery lines for the oil removed from the formation.

Yet another feature of this invention is to provide a method of recovering high viscosity oil from a formation utilizing recovery laterals wherein oil is repeatedly moved closer to the recovery laterals during the recovery operation.

It is another feature of the present invention to provide improved methods and apparatus for recovering high viscosity oils, wherein a driving fluid is injected into the formation from a plurality of conventional vertical wells, and oil is efficiently recovered from a plurality of substantially horizontal boreholes.

These and other features and advantages of the present invention will become apparent from the following detailed description, wherein reference is made to the figures in the accompanying drawings.

IN THE DRAWINGS

DETAILED DESCRIPTION

Figure 1:
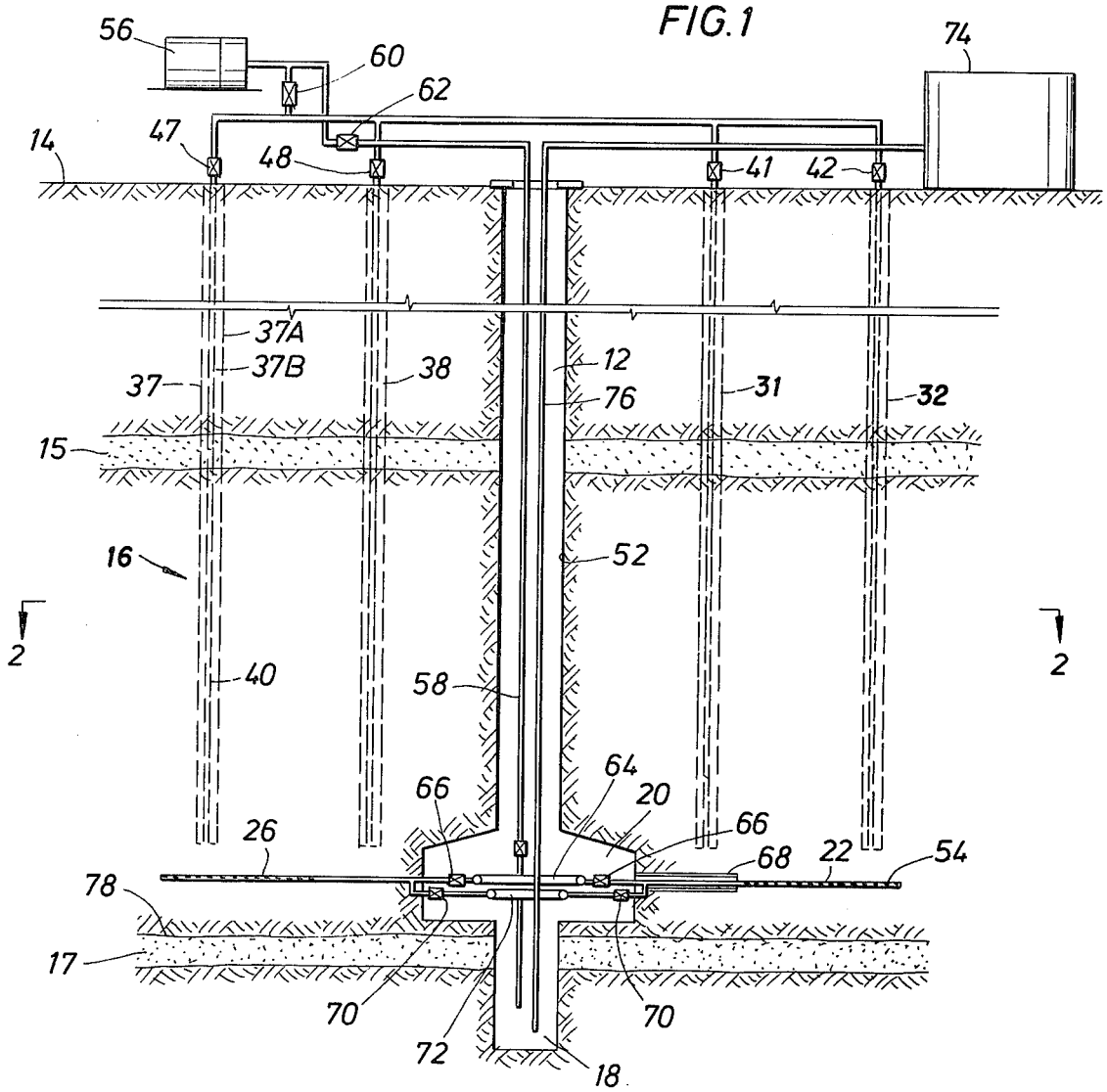
FIG. 1 is a simplified pictorial representation, partly in cross section, of an exemplary installation for recovering oil from a subsurface earth formation according to one embodiment of the present invention.

In FIG. 1, there may be seen a pictorial representation of an oil recovery system embodying the concepts of the present invention. In particular, the apparatus depicted in FIG. 1 may be utilized for recovering high viscosity oils from subsurface earth formations. A substantially vertical mine shaft 12 is drilled or bored from the surface 14 to the oil bearing formation 16. The oil bearing formation 16 may typically be hundreds of feet below the surface 14, and is shown to be bounded by an upper layer 15 and a lower layer 17 of rock or shale deposits, which are generally impregnable to fluid flow. As seen in FIG. 1, the mine shaft 12 is drilled through the oil bearing formation 16, and terminates at sump hole 18. The shaft 12 is expanded at the bottom portion of the formation to form a lower work chamber 20. A plurality of lower laterals 22 and 26 may be drilled into the formation from the lower work chamber 20.

The walls of the shaft 12 may be conveniently sealed with sections of bolted or welded steel plates to form a casing 52, or may be lined with an appropriate material such as gunite, to prevent caving or other collapse of the walls of the shaft 12. The diameter of the shaft 12 is preferably of a size sufficient to accommodate the passage of men and equipment from the surface 14 to the interior of the work chamber 20. The mine shaft 12 and the work chamber 20 may be constructed in the manner further described in U.S. Pat. No. 4,160,481. Each of the lower laterals extending from the work chamber 20 contains perfortions 54 for recovering oil from the formation 16.

A steam generator 56 on the surface may be utilized to inject a steam mixture into the formation through vertical injection wells 31–38, each injection well including a bore hole A and an injection conduit B. It may be seen from FIGS. 1 and 2 that each of these vertical bore holes 31A–38A are drilled from the surface 14 through the rock layer 15 and terminate within the formation 16. As explained in further detail below, each injection conduit 31B–38B may extend into a portion of the formation slightly above the horizontal laterals. Each injection conduit may be provided with perforations 40 for that portion of the injection conduit within the oil bearing formation for allowing steam to enter the formation. Respective valves 41–48 may be used to regulate and contol the flow of fluid from the generator 56 through each vertical well and into the formation.

It is also within the concept of this invention to initially inject steam into the formation from the horizontal laterals. Steam line 58 is therefore provided within the main shaft 12 and connects the generator 56 to the horizontal laterals. Main valve 60 between the generator 56 and the control valves 41–47 (representative valves 41, 42, 47 and 48 depicted in FIG. 1) may be regulated to control steam flow to the vertical wells. Valve 62 may be controlled to regulate steam flow to annular manifold 64, which supplies steam to each of the laterals. A remotely controlled valve 66 is provided between the manifold and each lateral, to separately regulate steam flow to individual laterals. Perforations 54 in the laterals allow steam to enter the formation along the length of the laterals. Alternatively, outer casing 68 may be provided over a portion of one or more of the laterals to limit the location of steam injection. For instance, outer casing 68 may be provided over the first one-third length of each lateral, which would thereby allow steam to enter the formation from only the remaining two-thirds portion portion of each lateral spaced farthest from the work chamber 20.

As explained in detail below, oil may be recovered from each of the laterals 21–28. The laterals may extend radially from the work chamber 20 into the formation 16, thereby "blanketing" a portion of the formation, as subsequently described. Regulating valve 70 may be provided for each of the laterals, so that the recovery of oil from individual laterals may be controlled. Thus, if valve 66 were closed and valve 70 open, it may be seen that oil may be recovered from the formation via lateral 26. Oil may then flow from the laterals into return manifold 72, and thereafter be pumped to collection tank 74 via recovery line 76. Alternatively, oil may flow from the manifold 72 to the sump hole 18, and thereafter be pumped to the surface. If desired, each of the valves 70 may be provided with a conventional flowmeter, so that the oil recovery rate from each of the laterals may be monitored.

Figure 2:
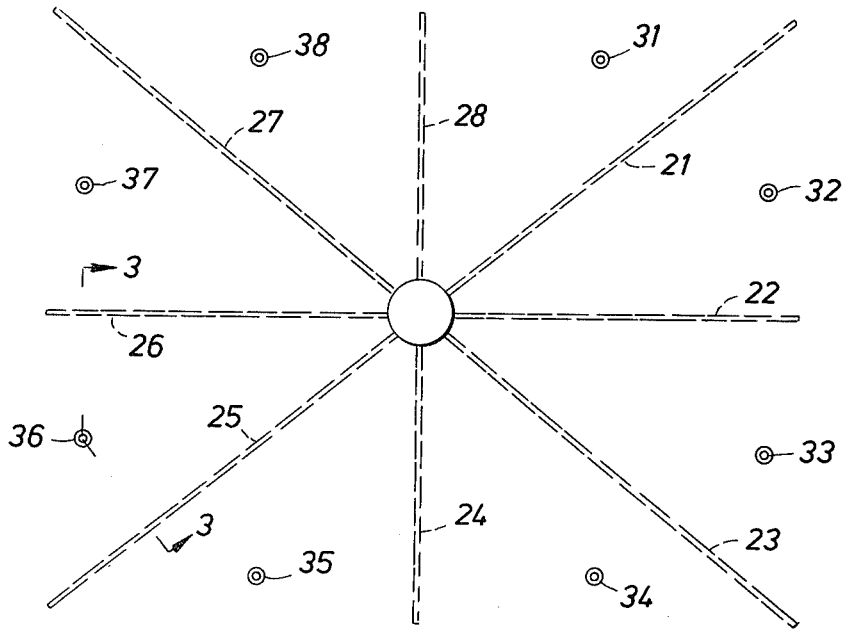
FIG. 2 is a horizontal or plan cross-sectional representation of a portion of the apparatus depicted in FIG. 1.

Referring now to FIG. 2, there is shown a horizontal cross-sectional view of a portion of the apparatus depicted in FIG. 1. The horizontal recovery laterals 21–28 form a generally rectangular blanket, although a circular, square, or other suitable blanket configuration is possible. Each of the laterals preferably lies within a plane generally conforming to the boundary surface 78 of the formation 16 and the lower layer 17, and typically may be 2 feet or less above the surface 78. In FIG. 2, it may be seen that the vertical wells 31–38 may be spaced between the horizontal laterals, and that the injection wells are spaced geographically to cover the area to be blanketed by the horizontal laterals. In particular, each of the injection wells 31–38 may be equally spaced in a horizontal direction between two of the lower laterals, and the radial distance from the center of the shaft 12 to each of the vertical wells may be 60% to 95%, and preferably between 80% to 90%, of a distance from the center of the shaft 12 to extremity of the blanketed lateral well configuration. The vertical wells are, therefore, preferably spaced between the recovery laterals and toward the periphery of the blanketed zone to increase the efficiency of the recovery operation.

The laterals 21–28 blanket a portion of the formation from which oil is recovered. Typically, the laterals will radiate from the working chamber 20 to enable a substantially horizontal blanket to be established having an area of approximately 25 acres. Recovery of oil according to the techniques described herein requires a considerable investment of labor and equipment. The drilling costs for the mine shaft 12 and laterals 21–28, and the costs associated with maintenance and operation of the steam generator 56 are high, and therefore a high percentage of the oil within the formation should be recovered in a relatively short period of time if the operation is to be economically feasible.

Because of the aforementioned drilling costs and the equipment costs, and because of variable formation characteristics, it may be economically desirable to recover oil from a single recovery well or mine shaft 12, and its associated recovery laterals, utilizing the capacity of steam generating equipment designed for that recovery well. In other words, the present invention is especially suitable for recovering oil from horizontal laterals blanketing a certain area and utilizing equipment principally adapted for servicing only that certain area. It is therefore a feature of the present invention that the full design capacity of the steam generating equipment 56 be utilized during most, if not all, of the time oil recovery operations are proceeding from the mine shaft 12 and laterals 21–28. The oil in that portion of the formation may therefore be efficiently recovered, without regard for the operation of possible adjacent recovery wells.

Referring again to FIG. 1, it may be seen that the vertical injection wells may extend into a lower portion of the formation. For instance, if a formation 16 were 123 feet thick, and the recovery laterals 21–28 were 3 feet above the surface 78, the vertical wells 31–38 may extend to a depth of approximately 20 feet above the recovery laterals. In this embodiment, each of the eight vertical wells will expose 100 feet of perforated pipe to the formation. As explained further below, the steam generator 56 may evenly distribute steam to each of the injection wells, so that in this embodiment steam may enter the formation from 800 feet of perforated pipe.

Although formation receptivity to injected steam will depend on particular formation characteristics, most formations will easily be able to initially absorb the full capacity of the steam generator 56 since a long length of perforated pipe is provided within the formation. Thus, the vertical injection wells of the present invention will be fully able to transmit the full capacity of the steam generator 56 to this formation, which may not be possible if the injection wells each terminated in the upper portion of the formation. As steam enters the formation from the vertical injection wells, oil within the formation is progressively pushed away from the vertical wells and the formation becomes heated. As steam is injected into the formation, therefore, the oil becomes less viscous and formation receptivity to injected steam increases in the vicinity of the vertical wells. After some period of time, it is thus possible to fully utilize the capacity of the steam generator 56 and inject the steam into the formation from only a portion of each of the vertical wells within the formation.

One method of recovering oil according to the present invention will now be described. Oil may be initially injected into the formation through perforations already provided within that portion of each vertical well within the oil bearing formation 16, or through perforations within a substantial portion of each vertical well within the oil bearing formation. As explained above, the length of perforated pipe within the formation enables the full capacity of a steam generator 56 to be utilized, so as to reduce the time required for recovering a high percentage of the oil within the formation.

As steam enters the formation 16 from a given vertical well, the steam will tend to rise within the formation to form a gas cap below the rock layer 15. Continued injection of steam will not only tend to reduce the oil viscosity in the formation with the vicinity of the recovery laterals, but the injected steam will also migrate upward to form a gas cap for driving the oil downward toward the recovery laterals. Each of the eight vertical wells 31–38 therefore contributes to the formation of a continuous gas cap below the rock formation 15 covering the entirety of the area blanketed by the recovery laterals 21–28.

Steam may be continually injected into the vertical wells while the recovery laterals are open for recovering oil. Thus, the process described herein is a dynamic driving operation, and is principally a dynamic vertical driving operation with the injected steam driving the oil downward to the recovery laterals.

Figure 3:
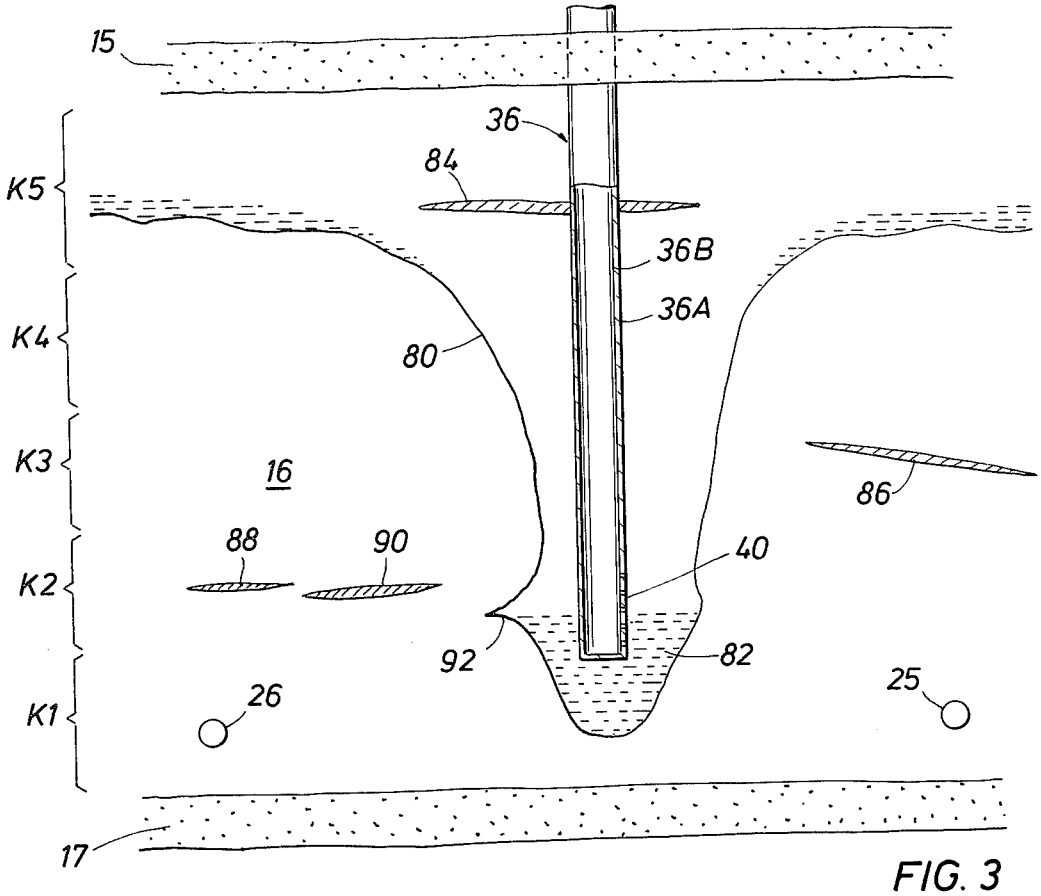
FIG. 3 is a simplified representation of a portion of the apparatus depicted in FIG. 1 during the oil recovery process.

FIG. 3 depicts the cross-section of a portion of the apparatus shown in FIG. 2 at some time period during the recovery operation. One-eighth of the capacity of the generator 56 may be injected into the formation through vertical well 36. The injected steam will generally tend to rise within the formation to form a gas cap of injected steam below rock layer 15. Oil within the formation will thus be driven vertically downward by the gas cap, and to a lesser extent will be driven horizontally from the vertical well 36 toward the recovery laterals 25 and 26.

Some of the steam may condense near the steam/oil interface 80, which serves as a driving fluid front for the driving operation. The interstitial water 82 may generally descend along the steam/oil interface to a location adjacent to the bottom of the vertical wells. The steam/oil interface or front during the driving process may be compared to a plurality of widening mushrooms each centered at an individual vertical well, with the steam layer adjacent the rock formation 15 forming the cap of the mushrooms. Alternatively, the steam/oil interface during the driving process may be viewed as a widening cone at each vertical injection well in conjunction with an increasingly thick steam cap driving the oil downward.

In this manner, oil may be effectively driven from the formation. Even though the formation 16 may contain lenses 84, 86, 88 and 90 which are generally impregnable to fluid flow, these lenses will not significantly affect recovery of oil utilizing the vertical drive in process, since the driving force of the steam will force the oil around the lenses and the steam will then engulf the lens.

A significant advantage of the vertical wells 31–38 is that the viscosity of the oil within the lower half of the formation is reduced by the injected steam and maintained at a reduced level during the driving process. Thus, extending the vertical wells into the lower portion of the formation may enable the oil to be more easily driven from the formation than if the vertical wells terminated near the top of the formation and the driving process commenced when the lower portion of the formation was "cold." Another advantage of the downward extending vertical wells 31–38 is that oil is, to some extent, moved horizontally during the steam driving process. This directs the oil toward the recovery laterals, so that oil in the lower portion of the formation between adjacent laterals may also be effectively recovered.

As stated above, the present invention may be effectively employed by utilizing a driving fluid and driving the oil vertically toward recovery laterals. In a vertical driving technique, the pressure gradient within the formation may be altered by the injected fluid to force the oil toward the recovery lines. Because of the weight of the oil in the formation, the pressure near the upper section of the formation will generally be less than the pressure in the lower portion of the formation. By way of illustration and referring to FIG. 1, if a formation 16 were 60 feet thick and the pressure at the top of the formation just below the layer 15 was 15 PSIg, the pressure at the bottom of the formation adjacent to the layer 17 may typically be 40 PSIg because of the pressure gradient of the oil in the formation 16.

According to the vertical steam driving techniques discussed herein, drawing the oil from the recovery lines 21–28 will produce a pressure differential sufficient to force or drive the oil vertically. Preferably, a pressure differential of 100 PSI or more is achieved during the driving process between the pressure at the place of injection and the pressure at the place of recovery within the formation. The preferred pressure differential will vary depending on specific characteristics of the oil and the formation, and typically a pressure differential of 200 PSI to 400 PSI will be desired. The maximum pressure at the place of injection is generally limited for safety reasons to 1 PSI per foot of overburden. For instance, if the rock layer 15 is 400 feet below the surface 14, it may be desired to limit the pressure of the injected steam in the upper portion of the formation 16 to 400 PSI.

Vertical drive, according to the present invention, may be properly utilized without concern for gravity override, even with injection rates far exceeding the injection rate employed in conventional horizontal drive techniques. In the embodiment described above, the density contrast between the oil and the injected fluid is deliberately utilized during the driving operation to increase the efficiency of the recovery processes, while the same density contrast may result in gravity override in horizontal drive operations thereby decreasing the efficiency of horizontal drive recovery processes. Also, since the oil is being driven vertically downward, the likelihood of viscous fingering during the driving operation is substantially eliminated since (a) a uniform blanket of driving fluid is formed at the top of the formation, (b) the interstitial water 82 acts, in part, as a face for driving the oil downward in the formation, and (c) the oil is being driven vertically downward, and the injected fluid will not tend to pierce through the formation 16 because the injected fluid is less dense than the oil below the injected fluid. Further, as explained below, viscous fingering prior to the driving operation increases the efficiency of the recovery process according to the present invention, rather than being detrimental to the recovery efficiency as in horizontal drive techniques.

A vertical drive operation according to the present invention benefits from a greater steam/oil interface area than that commonly associated with horizontal driving techniques. For instance, when conventional horizontal drive between vertical wells is utilized in a formation 60 feet thick, the area or face of the driving formation is typically approximately 12,500 square feet per acre. If vertical drive is practiced according to the present invention, the area or face of the driving front increases to approximately 43,000 square feet per acre. Thus, if the same injection rate per area of driving front is utilized, fluid is injected at approximately 3.5 times the rate as in conventional horizontal drive. Moreover, since the oil is being driven vertically rather than horizontally, the injection rate per area of the driving front may be substantially increased since viscous fingering is substantially eliminated during the driving operation.

A larger driving face area, therefore, enables more driving fluid to be injected into the formation while maintaining a relatively low, stable driving velocity through the formation. Also, as previously mentioned, the driving velocity may be substantially increased when compared to horizontal drive since vertical driving minimizes the likelihood of viscous fingering. Further, the fluid may be injected at higher pressures and at higher rates than realized in the prior art, which improves the efficiency of the recovery process. For instance, steam which may have been injected at 25% quality in horizontal drive operations may efficiently be injected at the higher rates and with greater steam quality, e.g., 80%, than in the prior art. Also, superheated steam may be used as the injected fluid.

In the methods described above, oil recovery is based on the vertical drive process, which may be simplistically described as injecting fluid in the formation for driving the oil downward while recovering oil from a set of substantially horizontal laterals. Although this invention is principally directed to an improved vertical driving technique, it is within the concept of my invention to improve the efficiency of the vertical driving process by providing for a limited soak cycle for the plurality of lower laterals 21–28. For instance, if a vertical downward drive of the oil is to be achieved, it may be initially desirable to inject steam in the lower laterals 21–28 to soak the formation directly adjacent to the lower laterals and thus improve the subsequent driving process. After the lower laterals have been opened and oil begins to flow in the lower laterals, steam may thereafter be injected into the vertical wells to drive the oil toward the lower laterals.

Soaking the formation about the lower laterals prior to establishing the driving process, as described above, may be beneficial in most applications. If a high viscosity oil is to be effectively driven, it may be desirable to establish many flow paths between the upper portion of formation and the lower recovery laterals prior to the driving cycle.

If steam is to be used as the injection fluid, the efficiency of the downward driving process may be increased by first injecting steam in the lower set of laterals 21–28. For this initial steam soak procedure, valve 60 may be closed and valve 62 opened allowing steam from the generator 56 to enter the formation through perforations 54 in each of the laterals 21–28. As the lower portion of a formation 16 is being soaked, viscous fingering and gravity override will readily occur since the injected fluid is lighter than the oil, and is being introduced in the lower portion of the formation. As viscous fingering and gravity override occur, heated communication paths will be established between the lower set of laterals and the upper portion of the formation. The pre-driving soak operation is utilized for reducing the time and pressure required for an effective driving operation and for initially recovering oil. The effects of viscous fingering and gravity override at this soaking stage are therefore not detrimental but are rather useful to the recovery operation. Thus, the formation may be subjected to one or more steam soak cycles from steam supplied through a lower set of laterals prior to the driving operation, wherein steam is injected into the lower laterals, the laterals are stopped off or shut in, and the laterals are opened for recovery of oil as a result of the soaking process. When the repeated soaking of the lower laterals results in steam fingering to the top of the formation 16, the soaking process may be discontinued and steam thereafter injected into the vertical wells 31–38 for driving the oil downward while recovering oil from the lower set of laterals.

An illustrative method of recovering oil according to the concepts of the present invention will now be discussed in further detail. After both the horizontal laterals and vertical wells have been drilled, steam from the generator 56 may be injected into the formation 16 from each of the lower laterals 21–28 for the soaking operation previously described. After steam migrates to the top of the formation, further steam injection in the lower laterals may be terminated, and the oil in the vicinity of the lower laterals should be sufficiently heated to a desired low viscosity. The desired time for this soaking operation will vary with formation characteristics, and the soaking operation may typically be complete in a period of approximately 120 days. The quantity of steam, expressed in equivalent volume of water, that is injected into the formation for the soaking operation may be between 5% to 10% of the pore volume of that portion of the formation affected by the soaking operation.

After the soaking operation is complete, valves 66 may be closed and valves 70 opened for the recovery of oil. Either simultaneously or shortly thereafter, valve 60 may be opened so that steam will be injected into the formation from each of the vertical wells while oil is being recovered from the horizontal laterals. As previously discussed, steam may be initially injected into the formation through perforations in that portion of each of the vertical wells within the formation. Steam injection at different levels within the formation is possible, as explained below. As the steam drive operation continues, formation receptivity to steam increases and a higher percentage of steam will therefore be injected into the upper portion of the formation. For instance, when the steam/oil interface approaches that depicted in FIG. 3, approximately 80% of this steam may be injected into the formation from the upper half of the perforated vertical wells. Also, interstitial water may tend to accumulate in the location adjacent the lower portion of each of the vertical wells, which will further reduce steam injection in the lower perforations 40.

Since the principal recovery mechanism according to the present invention is vertical steam drive, the above characteristics do not detract from the effectiveness of the operation. In fact, once the formation is heated and "hot flow paths" are established in the formation, it is desirable that steam be injected into the upper portion of the formation to drive the oil downward. If desired, the location of steam injection from each vertical well may be controlled by a variety of procedures. Sand or cement may be pumped into the vertical wells to plug off the lower portions. Alternatively, standard packers or bridge plugs may be used to regulate the steam injection location from each of the perforated vertical wells.

In FIG. 2, the location of each of the vertical wells is depicted according to one embodiment of the present invention. Each of the vertical wells may be evenly spaced horizontally between respective recovery laterals and positioned toward the periphery of the blanketed zone. The vertical wells may therefore lie in a circular or oval configuration within the blanketed area defined by the horizontal recovery laterals. Additional vertical wells may be provided, although it is a feature of this invention to provide an equal number of vertical wells and horizontal laterals, and to space each of the vertical wells between respective horizontal laterals.

The formation 16 depicted in FIG. 3 is divided vertically into five imaginary zones K1–K5 of equal thickness. In the cross-sectional view depicted, K5 includes lens 84, K3 is shown to contain tilted lens 86, and K2 has lenses 88 and 90. Although each of these lenses may be impregnable to fluid flow, the efficiency of the recovery operation is not seriously altered since the vertical driving technique pushes the oil around these lenses. Recovery laterals lie within the lower zone K1 and may be 5 feet or less above the rock layer 17.

Although each of the vertical wells may terminate in any of the zones K1–K5, it is a feature of this invention that the vertical wells extend into the lower half or lower portion of the formation, and therefore terminate in zones K1, K2, or K3. It is desirable to minimize the likelihood of steam short circuiting between the lower portions of the vertical wells and one of the recovery laterals. For this reason, the vertical wells preferably terminate at a location above the horizontal laterals, and may terminate above zone K1. The lower the vertical wells extend, however, the greater the length of perforated pipe within the formation to maximize initial injection rates, and the injected steam is better able to maintain and reduce the viscosity of the oil in the lower portions of the formation.

Injection through the vertical wells 31–38 while recovering oil from the horizontal laterals 21–28 may continue until a high percentage of the oil is efficiently driven from the formation. As noted earlier, the steam/oil interface at the location of each of the vertical wells will generally widen as the process continues, but the principal driving force remains the vertical driving mechanism of the increasing gas cap. Thus, the ceiling of the steam/oil interface is descending while steam is injected into the vertical wells to drive the oil downward to the recovery laterals.

As the dynamic driving process continues, and especially when the steam/oil ceiling is in the lower portions of the formation, a possibility exists that steam may short circuit or finger through to one of the recovery laterals. Referring to FIG. 3, for example, it may be seen that steam has started to break through the normal steam/oil interface at 92, which may be attributable to any number of formation characteristics. As the vertical driving process continues, the degree of fingering at 92 may increase to the extent that the tip of the finger extends to recovery lateral 26, so that steam "breaks through" to the recovery lateral.

It is within the concept of this invention to increase the efficiency of the vertical driving operation by healing steam breakthroughs, and thereby minimizing the detrimental effects of steam fingering that are possible during the latter stages of the driving operation. Healing of steam breakthroughs may be accomplished by reducing or choking back the recovery from the specific lateral receiving steam. For instance, if steam does break through to lateral 26, recovery may be reduced by totally or partially closing valve 70 for lateral 26. Partially closing valve 70 for this lateral would have the effect of increasing the pressure in the area of the formation adjacent lateral 26. The effect will be a smaller pressure differential than previously existed, which will cause the steam breakthrough path to tend to seal or heal with viscous oil and/or water. After a period of time, valve 70 for lateral 26 may be further opened, and the oil may be recovered at a normal rate without steam breakthrough.

It should be noted that this healing of steam fingering, as described above, is unique to vertical drive operations and cannot be efficiently accomplished in a horizontal drive operation. During horizontal drive, steam breakthrough to vertical recovery wells generally occurs in the upper portion of the formation because of the affects of gravity override. Choking back the vertical recovery well is possible, of course, but this will not tend to heal the path of this steam fingering. In the vertical drive operations described above, however, steam fingering is not likely to occur until the latter stages of the recovery operation and the steam fingering path is generally at a downward angle to the recovery well. Thus, choking back on the lateral recovery well allows viscous oil and water to descend due to gravity and steam pressure, so that the downward extending fingering path may be allowed to seal or heal.

This healing operation is a significant feature of present invention, since the life of the driving operation may be effectively prolonged. Using horizontal drive techniques, steam may typically break through to a recovery well after one year of driving operation. Since healing of the breakthrough is not generally practical, the driving operation must then be terminated. In the vertical driving operation described, steam breakthrough is less likely to occur. Equally significant, the breakthrough may be efficiently healed so that the driving operation may be prolonged. Thus, vertical steam drive with the above healing procedure may allow the driving operation to continually proceed for approximately five years, until a high percentage of the oil is efficiently driven from the formation.

Other methods of healing the steam fingering previously described are possible, and will now be discussed. Steam may be continually injected into the vertical wells 21–28 until a significant amount of condensate or steam has been recovered from one of the lower laterals 31–38. At this point, further injection of steam may not be economical, since little if any further oil will be recovered from the lower lateral receiving steam. If individual vertical recovery lines are used to connect each lateral to the recovery tank 74, it is possible to monitor the fluid being recovered at the surface 14 from each lower lateral. In this manner, it may be desirable to discontinue the injection of steam into vertical wells which are adjacent the lower lateral in which steam or condensate is being recovered, while continuing to inject steam into the other vertical wells as long as oil is being produced from their respective adjacent lower laterals. If the recovered oil is either being forwarded to a subsurface manifold 72 or is being taken from a common sump hole 18, the monitoring of the recovered fluid from the individual lower laterals may be accomplished before that fluid is intermingled with fluid from the other lower laterals.

Referring again to FIG. 2, the following is an example of the monitoring procedure described above. Steam may be initially injected into the eight vertical wells 21–28, as described above. Continued injection of the steam will drive the oil in the formation to the lower laterals. Once steam or condensate has been recovered from one of the lower laterals, e.g., lateral 21, steam may continue to be injected into the vertical wells 33–38, while steam is not injected through the vertical wells 31 and 32. Thus, oil recovery will continue from the lower laterals 22–28, but steam production from the lower lateral 21 would be effectively discontinued. Oil recovery may thereafter continue from lateral 21 by gravity drainage.

An alternate procedure that may be used when steam or condensate is recovered in one of the plurality of lower laterals is to inject cold water into the lower lateral while continuing steam injection into all the vertical wells. Referring to the example described immediately above, if steam or condensate is being recovered from the lower lateral 21, cold water may be injected into lower lateral 21 while continuing to inject steam in either upper laterals 33–38 or all the upper laterals 31–38. The introduction of cold water into the lower lateral 21 effectively terminates the recovery of any fluid from the lower lateral, and thus the steam subsequently injected into the formation would be effectively used to produce oil from the laterals 22–28. The injected cold water scavenges heat from the formation adjacent lateral 21, generating some steam in situ, which, together with hot water, displaces additional oil to the other laterals.

The method of recovering oil described above may be characterized as embodying a dynamic vertical drive technique, since fluid is injected into the vertical wells as oil is recovered from horizontal laterals and the driving force is primarily vertically downward. Although a dynamic vertical drive may be preferred because of the reduced time required to efficiently recover a high percentage of oil, it is within the concept of this invention to employ a modified driving technique herein described. The modified driving technique utilizes "drive" principles since fluid is injected at one place in the formation and oil is driven under pressure to recovery from another location. The modified drive technique differs from the dynamic drive operation, however, in that fluid is not injected while oil is recovered.

According to the modified drive technique of this invention, the recovery laterals 21–28 may be initially soaked, in the manner previously described. Thereafter, steam may be injected into the formation through the perforations 40 provided in each of the vertical injection wells, while both valves 66 and 70 for each lateral are closed and the laterals are thus shut in. The desired time of steam injection will necesarily vary with formation characteristics. Since the recovery laterals are shut in and steam breakthrough is not possible at this time, however, the injection period may be quite short, e.g., 30 days.

Steam injection into the formation from each of the vertical wells may then be terminated or substantially reduced, and each of the recovery laterals 21–28 opened for the recovery of oil. Once the rate of oil recovery drops below an acceptable value, the recovery laterals may again be shut in (or substantially restricted), and steam re-injected into the vertical wells. The second injection period may then be terminated, and oil again recovered from the laterals. The sequence may be continually repeated until the oil is driven from the formation.

It may be seen that oil is recovered in the modified drive operation in a manner similar to the dynamic drive operation, except that the recovery of oil may take longer since oil is not recovered when steam is injected. Except for the initial soak operation, which is optional, oil is always driven toward a recovery lateral. Thus, energy is not wasted moving oil back and forth in the formation, as is common to soak techniques.

The above modified drive technique similarly is not burdened by the detrimental effects of fingering and gravity override. A steam/oil interface thus may be established in a manner similar to the dynamic vertical drive technique. A gas cap may be formed below the rock layer 15, and steam pressure exerts a downward force driving oil toward the recovery laterals. Also, the above described "healing" of steam fingering is possible in conjunction with the modified vertical driving technique. For example, the recovery lateral receiving steam may be choked back during the recovery cycle, while the remaining laterals are fully open to receive oil.

The oil recovery efficiency of the present invention may be improved by injecting an inert gas into the formation after steam injection and steam drive has been accomplished. Once the oil in the formation is sufficiently heated to a desired reduced viscosity and the steam/oil interface has been adequately established, inert gas injection may accomplish the same vertical driving force as steam injection. The net oil recovery efficiency should increase, however, since the production of steam requires much more energy than a similar volume of either cold or hot noncondensable gas. Injected gas will rise to the top of the formation to drive the oil downward, and will not tend to condense if the formation temperature declines. A suitable noncondensable gas for either a dynamic vertical driving operation or a modified vertical driving operation after steam injection is either nitrogen or stack gas.

Another technique for further improving the efficiency of the oil recovery operation includes the injection of cold water into the formation through the vertical wells after the formation is sufficiently heated by steam and the steam/oil interface or ceiling is driven vertically through the formation.

Water is customarily injected into a formation during conventional horizontal drive operations after steam injection to scavenge heat from the formation. The cold water is typically injected at the maximum possible rate to provide ample mechanical energy to displace the oil at high rates.

According to the present invention, which utilizes vertical drive techniques, cold water may be injected after steam injection, but cold water injection preferably occurs at less than the maximum possible injection rates. For instance, for the approximately 25 acres blanketed by the laterals depicted in FIG. 2, cold water may be injected from the vertical wells at a rate of approximately 200–400 barrels of water per day per injection well, which may be 10 to 20% of the maximum rate of injectivity. When water is injected into the formation at this lower rate, heat from the formation may be effectively used to create steam in situ. The additional creation of steam increases the gas cap volume which is beneficial to the vertical driving techniques disclosed herein. In a vertical drive technique, this low injection rate of cold water prevents the collapse (condensation) of the steam previously existing in the formation and thereby increases the driving pressure of the operation.

An alternate method of practicing vertical steam drive in conjunction with cold water injection will now be discussed. Steam may be injected into the formation from each of the vertical wells 31–38 while oil is recovered from laterals 21–28. After the steam cap has filled the upper fifth of the formation, e.g. zone K5 in FIG. 3, steam injection in zone K5 is terminated, and cold water is injected into the wells 31–38 to result in the provision of steam below zone K5. In response to cold water injection into the wells 31–38, steam is formed in situ and thus injected into zone K4. Once the steam/oil ceiling drops below zone K4 as vertical drive continues, injection of steam into zone K4 is terminated, and cold water is injected into the wells 31–38 to be converted in situ into steam to lower the steam cap below zone K4 simultaneous with or immediately prior to injection of steam into the wells 31–38 which then rises to zone K3. In this manner, sequential layer to layer of steam injection, followed by water injection exploiting the above layer, may be effectively practiced. The vertical drive concept of the invention is thus utilized, and the injection of cold water minimizes the fuel cost for the recovery operation, and thus increases the net oil recovery rate.

In the embodiments of this invention described above, the primary mechanism for oil recovery is downward vertical drive; injected fluid rises to the top of the formation forming a gas cap which drives the oil downward to recovery laterals. It is also within the concept of this invention to drive vertically upward, and the conventional vertical bore holes herein described may terminate near the bottom of the formation if upward drive is desired.

Figure 4:
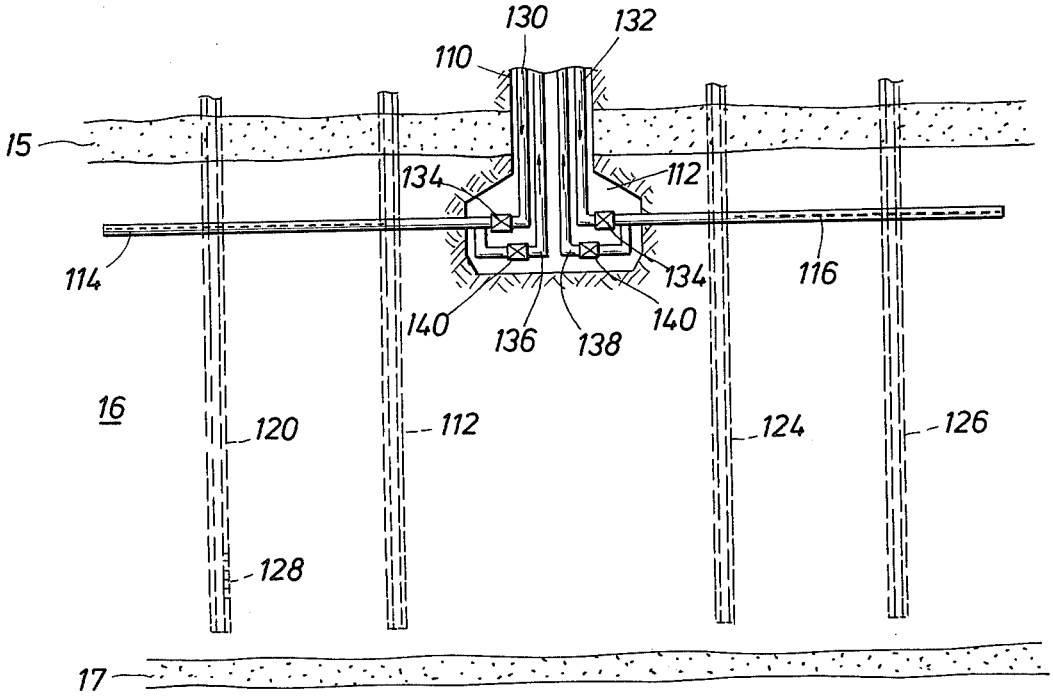
FIG. 4 is a simplified representation of another embodiment of the present invention.

A portion of an apparatus embodying the upward vertical drive concepts of this invention is depicted in FIG. 4. A formation 16 is shown to be bounded by upper rock layer 15 and a lower rock layer 17. The apparatus above rock layer 15 is not depicted, but may be similar to that shown in FIG. 1, and will be readily understood.

The mine shaft 110 and upper work chamber 112 may be constructed in the manner previously described. A plurality of recovery laterals extend from the formation and blanket an area from which oil is to be recovered. Although only two laterals 114 and 116 are depicted in FIG. 4, eight laterals may extend from the work chamber 112 in a rectangular pattern as depicted in FIG. 2. Any plurality of laterals may be provided, however, which will lie in a generally horizontal plane and blanket a desired area. The work chamber 112 may be constructed either below the upper rock layer 15 or within the rock layer 15 and the formation 16. The laterals 114 and 116 preferably are immediately below the rock layer 15, and may typically be 5 feet or less from the formation 16/rock layer 15 interface.

Vertical wells 120, 122, 124 and 126 are depicted in FIG. 4, and each vertical well may be constructed in a manner similar to vertical well 37, with perforations 128 in that portion of each vertical well within the oil bearing formation 16. Although only four vertical wells are depicted in FIG. 4, it is to be understood that the number and position of the vertical wells will depend on the number of horizontal laterals, and that the vertical wells are preferably positioned between adjacent laterals and toward the periphery of the blanketed area, as previously described. For instance, if the laterals in FIG. 3 blanket an area as depicted in FIG. 2, eight vertical wells may similarly be provided, with the vertical wells positioned as shown in FIG. 2. Each of the vertical wells preferably terminates in the bottom half of the formation, and may terminate several feet above the rock layer 17.

In FIG. 4, it may be seen that each of the laterals 114 and 116 is provided with a respective steam injection line 130 and 132. Valves 134 may be located within the work chamber 112 or may be placed at the surface, and may regulate steam injection to each of the laterals. Oil may be recovered from laterals 114 and 116 by respective recovery lines 136 and 138. Similarly, valves 140 may be located at the surface or in the work chamber to control recovery from each lateral. Although only two laterals are depicted in FIG. 4, it is to be understood that individual injection lines, recovery lines, and control valves may be provided for each recovery lateral.

One method of recovering oil according to the concepts of this invention will now be described for the apparatus depicted in FIG. 4. If desired, steam may be injected into each of the laterals 114 and 116 to soak the area adjacent each lateral. Thereafter, water may be injected into each of the vertical wells, and water will enter the formation through perforations 128 in that portion of each of the vertical wells within the oil bearing formation. At the temperature and pressure within the formation in FIG. 4, it may be assumed that water is more dense than the oil within the formation. Water will, therefore, migrate downward and form a substantially horizontal bed adjacent rock layer 17. Further injection of water will create a sufficient pressure force to drive the oil upward toward the recovery laterals. In this manner, oil may be efficiently recovered by an upward drive technique.

As the vertical drive operation progresses, the injected water/oil interface may proceed through the formation in the manner previously described, except that the interface will be flipped. In other words, the oil water/oil interface during the driving operation described above may resemble a plurality of cones with the apex of the cones near the top of the formation, and an increasingly thick substantially horizontal and continuous bed of water above rock layer 17. The vertical wells may be perforated for the entire portion within the oil bearing formation, and a limited amount of horizontal drive may occur, although the principal drive mechanism will be an upward vertical driving force.

A dynamic upward vertical drive is preferably utilized to recover oil for the embodiment depicted in FIG. 4, although a modified vertical drive procedure is possible. Since the injection of water is heavier than the oil within the formation, problems associated with gravity override and steam fingering are minimized, if not eliminated. Once cold water breaks through to one of the upper recovery laterals, that lateral may be shut in, in the manner previously described for the lower laterals, so that the drive operation may continue for the other upper laterals.

Although cold water has been described as the injected fluid, many hot or cold liquids could be utilized for the upward vertical drive technique which have a density greater than the oil within the formation. Since upward vertical drive is desired, injection of an inert gas after fluid injection may not be practical.

One significant advantage of the apparatus depicted in FIG. 4 is that the mine shaft need not extend through the oil bearing formation. Also, a cold liquid may be injected into the formation for the driving mechanism, which will substantially reduce equipment and operational costs. The vertical wells need not be fully perforated within the oil bearing formation, and may either be partially perforated or merely inject fluid into the formation from the end of the vertical wells. If the vertical wells are fully perforated, however, cold water may be injected at higher rates, and a minimal amount of horizontal drive will push the oil closer to the recovery laterals.

Although this invention is principally described with steam or water as the injection fluid, both heated and unheated fluids may be used as a driving force within the concept of this invention. For example, water, solvents, gas oil, distillate, LPG, and naptha, or a combination of liquids and gases may be utilized as a driving fluid according to the present invention. Examples of gases that may be utilized in this invention are air, oxygen, hydrogen, carbon dioxide, inert gas, stack gas, steam, anhydrous ammonia, natural gas, ethane, propane, and butane. Also, although no additives must be combined with the fluid to be injected, the addition of additives may enhance the recovery process. Less heat is lost through condensation, and the average temperature of the formation is raised at a faster rate than in the prior art. Thus, the increased injection rates yield higher production rates, which improve the economics of the recovery operation.

The recovery of oil when utilizing vertical drive, as described according to this invention, may be further enhanced by reducing the pressure at the recovery laterals to a sub-atmospheric value while connecting the recovery laterals to suction-type pumps. In this manner, oil recovery may be enhanced regardless of whether the vertical drive is propagated by in situ combustion, steam injection, solvent injection, gas injection, or injection of any number of fluids commonly used to enhance the driving operation.

The present invention employs a vertical driving concept with oil recovery from a plurality of substantially horizontal laterals. In both the dynamic vertical drive technique and the modified vertical drive technique, oil is being continually driven toward the recovery laterals, and energy is not wasted moving oil back and forth within the formation. Nevertheless, an initial steam soak operation may be performed as described herein. Also, it may be beneficial to periodically "purge" the recovery lines for a short period by injecting steam through the laterals, although the recovery mechanism remains that of vertical steam drive.

The fluid injected into the conventional vertical wells according to the present invention serves to establish a uniform, substantially horizontal blanket to be driven vertically through the formation. The recovery laterals are generally positioned at a substantially horizontal plane, which may be inclined to conform to the inclination of the adjacent barrier layer, so that the formation may be effectively swept of oil. Some deviation of the laterals is expected, and in that sense the laterals may not lie precisely in flat planes. Further, the laterals typically lie in relatively thin discs approximately 5 feet thick, and these discs or "planes" may be inclined slightly to conform to the barrier layers.

It may also be seen that the present invention may be profitably employed by installing a plurality of vertical mine shafts and laterals, as described herein. Also, by operating such multiple installations in a simultaneous manner, an entire field may be drained in a systematic manner.

It may be that two or more oil bearing formations exist at different elevations. In such a case, it is within the concept of this invention that a vertical mine shaft may be employed, and the vertical wells and recovery laterals may extend from the mine shaft into each of the oil bearing formations.

As herein described, the techniques of the present invention are principally directed to recovering relatively heavy oils. However, it should be noted that these techniques are not limited to heavy oils only, but can be used with substantial effect in recovering hydrocarbons of various weights and gravities.

Other alternate forms of the present invention will suggest themselves for a consideration of the apparatus and practices hereinbefore described. Accordingly, it should be clearly understood that the systems and techniques depicted in the accompanying drawings, and described in the foregoing explanation, are intended as exemplary embodiments of my invention, and not as limitations thereto.

What is claimed is:

1. A method of recovering oil from a subsurface earth formation in which formation a steam cap can form comprising:

establishing a shaft hole extending from the surface to said subsurface earth formation;

drilling a first plurality of boreholes radially from said shaft hole in a substantially horizontal plane within a lower portion of said formation, said first plurality of boreholes defining a blanketed zone;

drilling a second plurality of boreholes within the blanketed zone substantially vertically from said surface into said formation, said second plurality of boreholes extending to a depth above said first plurality of boreholes;

heating oil in said formation by injecting a heating fluid into one of said plurality of boreholes;

injecting steam into said second plurality of boreholes to form a gas cap; and thereafter discontinuing injection of steam through said plurality of boreholes and injecting water such that said water is converted to steam to further provide for drive of oil by said gas cap towards said first plurality of boreholes.

2. The method according to claim 1 wherein the step of injecting water comprises injecting at a rate which is a fraction of the rate of injectivity of said formation.

3. The method according to claim 2 wherein the step of injecting water comprises injecting at the rate of 10–20% of the maximum rate of injection and wherein said step is performed subsequent to recovery of oil from said formation.

4. The method according to claim 1 wherein the step of injecting water following injecting steam comprises performing a plurality of cycles of injecting steam through said second plurality of boreholes, discontinuing injecting steam and then injecting water.

5. The method according to either of claims 3 or 4 wherein the step of injecting steam into said second plurality of boreholes further comprises the step of injecting non condensable gas in addition to injecting steam.

6. The method according to either of claims 3 or 4 wherein the step of injecting fluid into one of said first or second plurality of boreholes comprises the step of injecting steam into said first plurality of boreholes, and performing a soaking operation prior to injection of steam into said second plurality of boreholes.

7. The method according to claim 6 wherein the step of injecting heating fluid comprises injecting steam.

8. The method according to claim 7 further comprising the steps of monitoring oil recovery from each of said first plurality of boreholes, and regulating injection of steam through selected ones of said second plurality of boreholes in response to oil recovery from each of said first plurality of boreholes.

9. The method according to claim 7 wherein the step of drilling said second plurality of boreholes comprises spacing each borehole of said second plurality of boreholes equally in a horizontal direction between two of said boreholes within said first plurality of boreholes.

10. The method according to claim 9 wherein the step of drilling said second plurality of boreholes further comprises spacing each of borehole in said second plurality of boreholes 60 to 95% of the distance from the center of said shaft hole to to the extremity of the blanketed zone.

11. The method according to claim 10 wherein the step of providing said first plurality of boreholes comprises providing eight radially exrending boreholes and wherein the step of providing said second plurality of boreholes comprises providing eight boreholes terminating twenty feet vertically from said first plurality of boreholes and wherein each of said second plurality of boreholes exposes one hundred feet of perforations in a vertical direction to said formation.

12. In a method of recovering oil from a subsurface earth formation in which formation a steam cap can form comprising the steps of establishing a shaft hole extending from the surface to said subsurface earth formation; drilling a first plurality of boreholes radially from said shaft hole in a substantially horizontal plane within a lower portion of said formation; drilling a secondary plurality of boreholes substantially vertically from said surface into said formation, said second plurality of boreholes extending to a depth above said first plurality of boreholes; heating oil in said formation by injecting a heating fluid into one of said plurality of boreholes; the improvement comprising:

injecting steam into said second plurality of boreholes to form a gas cap; for causing production from said first plurality of boreholes and thereafter discontinuing injection of steam through said plurality of boreholes and injecting water such that said water is converted to further provide for drive of oil by said gas cap.

13. The method according to claim 12 wherein the step of injecting water comprises injecting at a rate which is a fraction of the rate of injectivity of said formation.

14. The method according to claim 13 wherein the step of injecting water comprises injection at the rate of 10–20% of the maximum rate of injection and wherein said step is performed subsequent to recovery of oil from said formation.

15. The method according to claim 14 wherein the step of injecting water following injecting steam comprises performing a plurality of cycles of injecting steam through said second plurality of boreholes, discontinuing injecting steam and then injecting water.

* * * * *